US005954392A

United States Patent [19]

Liss et al.

[11] Patent Number: 5,954,392

[45] Date of Patent: Sep. 21, 1999

[54] RECLINING CHAIR HAVING CONTINUOUS ARM REST/LEG REST MEMBER

[75] Inventors: Kenneth W. Liss, Newport; Jack R. Lewis, Monroe, both of Mich.

[73] Assignee: La-Z-Boy Incorporated, Monroe, Mich.

[21] Appl. No.: 09/062,456

[22] Filed: Apr. 17, 1998

[51] Int. Cl.[6] ..... A47C 1/02

[52] U.S. Cl. ..... 297/85; 297/DIG. 7

[58] Field of Search ..... 297/85, 68, 423.1, 297/423.34, DIG. 7, 423.19, 258.1, 83, 84, 411.42, 411.2, 354.12, 341, 342, 271.6

[56] References Cited

U.S. PATENT DOCUMENTS

| | | | |
|---|---|---|---|
| 163,389 | 5/1875 | McDonough | 297/78 |
| 860,421 | 7/1907 | Strand | 297/78 X |
| 3,096,121 | 7/1963 | Knabusch et al. . | |
| 3,139,306 | 6/1964 | Jennings et al. | 297/423.1 X |
| 4,179,157 | 12/1979 | Shoemaker et al. . | |
| 5,087,094 | 2/1992 | Rogers, Jr. | 297/85 X |
| 5,156,441 | 10/1992 | Byersmith, et al. . | |
| 5,171,000 | 12/1992 | LaPointe et al. . | |
| 5,184,871 | 2/1993 | LaPointe et al. . | |
| 5,192,113 | 3/1993 | Wiecek | 297/85 |
| 5,222,286 | 6/1993 | Saul et al. . | |
| 5,288,126 | 2/1994 | Saul et al. . | |
| 5,301,413 | 4/1994 | Habegger, et al. . | |
| 5,388,886 | 2/1995 | LaPointe et al. . | |
| 5,435,621 | 7/1995 | Komorowski et al. . | |
| 5,435,622 | 7/1995 | Fay et al. . | |
| 5,527,095 | 6/1996 | Marshall et al. . | |
| 5,582,457 | 12/1996 | Komorowski et al. . | |
| 5,664,832 | 9/1997 | Stevens et al. . | |

OTHER PUBLICATIONS

"Medalounger" chair brochure, Medal Veldeman Motion, cover page and pp.5 and 6 (Clio model).

*Primary Examiner*—Milton Nelson, Jr.
*Attorney, Agent, or Firm*—Harness, Dickey & Pierce, P.L.C.

[57] ABSTRACT

A chaise lounge recliner/rocker chair is provided which incorporates an arm/leg rest member and an intermediate leg support member for providing support to an occupant of the chair. The arm/leg rest member is connected to a portion of the chair frame side panels and a portion of the leg rest member while the intermediate leg support member is independently connected to a portion of the seat member and a portion of the leg rest member. When the leg rest member is in a retracted position, the arm/leg rest member and intermediate leg support member overlie portions of the upright chair. As the leg rest member is moved to an extended position, the arm/leg rest member has its degree of arcuate curvature progressively reduced and finally extends in an essentially planar configuration between the side panels and the leg rest member. As the seat back of the chair is reclined, it causes the seat member to slide towards the extended leg rest member which causes the intermediate leg support member to assume a pronounced convex shape.

31 Claims, 6 Drawing Sheets

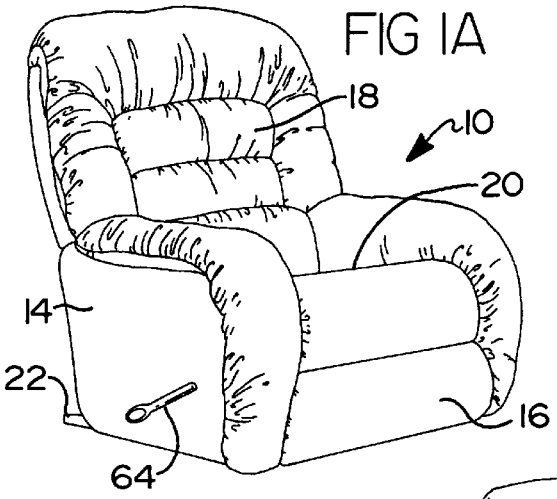
FIG IA
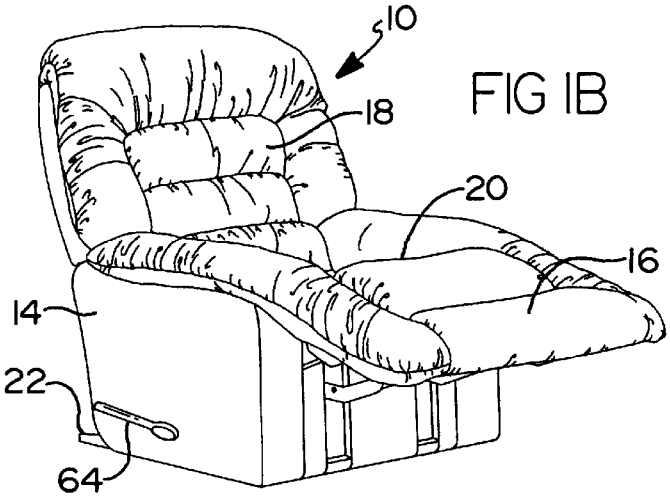
FIG IB
FIG IC
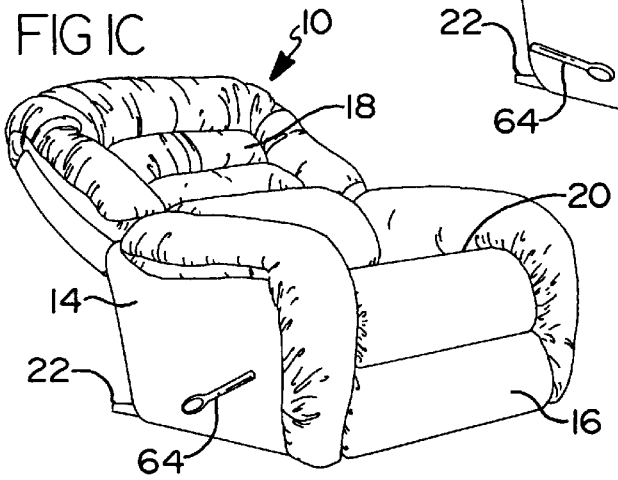
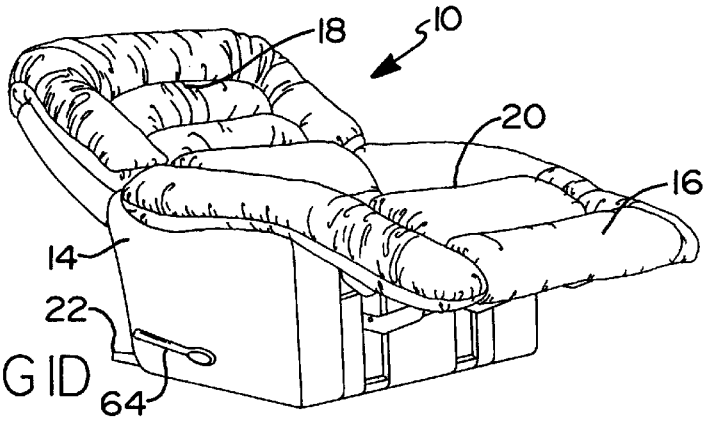
FIG ID

RECLINING CHAIR HAVING CONTINUOUS ARM REST/LEG REST MEMBER

BACKGROUND OF THE INVENTION

1. Technical Field

The present invention relates generally to reclining chairs and, more particularly, to a reclining/rocking chair having an intermediate leg support member and a continuous arm rest/leg rest member.

2. Discussion

Most reclining/rocking chairs typically include an upholstered chair frame supported from a stationary base assembly in a manner permitting the chair frame to "rock" freely with respect to the base assembly. In order to provide enhanced comfort and convenience, many rocking chairs also include a "reclinable" seat assembly and/or an "extensible" leg rest assembly. For example, combination platform rocking/reclining chairs, as disclosed in Applicant's U.S. Pat. Nos. 3,096,121, 4,179,157, and 5,527,095, permit reclining movement of the seat assembly and actuation of the leg rest assembly independently of the conventional "rocking" action. The leg rest assembly is operably coupled to a drive mechanism for permitting the seat occupant to selectively move the leg rest assembly between its normally retracted (i.e., "stowed") and elevated (i.e., "extended") positions. The drive mechanism is manually-operated and includes a handle which, when rotated by the seat occupant, causes concurrent rotation of a drive rod for extending or retracting the leg rest assembly.

As an additional comfort feature, a latching mechanism may also be provided for releasably retaining the chair frame in a rearwardly rocked or "tilted" position on the base assembly following extension of the leg rest assembly towards its extended position. In this manner, normal "rocking" action of the rocking chair is inhibited until the leg rest assembly is returned to its normally "stowed" position.

While the leg rest assembly typically provides sufficient support for the legs of the seat occupant, there are areas of the legs, primarily behind the knees and thighs, which benefit from even further, more direct support. For instance, it is advantageous to incorporate an intermediate variable support member in the form of an attached cushion into the recliner between the recliner seat and the foot rest. For example, an intermediate support member, as disclosed in Applicant's U.S. Pat. No. 5,156,441, which is incorporated by reference herein, provides enhanced support for the upper portions of the legs, such as the backs of the thighs and knees, of the seat occupant when the leg rest member is in its extended position.

Additionally, the sides of the legs, primarily adjacent the knees and calves, would benefit from further containment and support. While it is known to provide padding on the sides of the chair frame (i.e., the side panels) to laterally cushion the seat occupant, it would be advantageous if an intermediate lateral support member in the form of a continuous arm rest/leg rest cushion was incorporated into the recliner. Such an arm/leg rest member would provide enhanced support and containment for the legs and arms of the seat occupant when the leg rest member is in its extended position.

Such an intermediate support member and arm/leg rest member as described above, when used with a reclining chair, would enable a chair to provide an occupant with increased degrees of cushioned support extending continuously from the upper back to the feet. Further, the arm/leg rest member, in combination with the leg rest assembly, would enable the chair to provide an occupant with increased cushioned support surface area extending continuously across the front width of the chair.

SUMMARY OF THE INVENTION

In accordance with the principles of the present invention, an improved reclining-type article of furniture is disclosed which is designed to enhance the advantages of conventional reclining chairs. Therefore, one primary object of the present invention is to provide an improved recliner having an arm/leg rest member integrally formed intermediate a side panel portion and an extendible leg rest member of the recliner to provide additional surface area for resting the arms and legs of an occupant of the recliner when the leg rest member is in its extended position.

It is another primary object of the present invention to provide an improved recliner having a leg support member coupled intermediate a seat portion and an extendible leg rest member of the recliner to provide variable support to the backs of the thighs and knees of an occupant of the recliner when the leg rest member is in its extended position.

It is yet another primary object of the present invention to provide an enlarged arm/leg rest member extending continuously from the side panel portion to the extendible leg rest member of the recliner to provide increased degrees of freedom to the occupant of the recliner to position her arms and/or legs when the leg rest member is in its extended position.

It is still yet another object of the present invention to provide an improved recliner having the arm/leg rest member being variably positionable between a retracted position adjacent the chair frame and an extended position spaced apart from the chair frame as the leg rest member is moved relative to the chair frame.

It is an additional object of the present invention to provide an improved recliner having the arm/leg rest member being highly arcuately shaped under tension between each side panel and the leg rest member when the leg rest assembly is positioned in its stowed position so as to complement the curvature of the seat portion and having an essentially planar shape under tension between each side panel and the leg rest member when the leg rest assembly is positioned in its extended position so as to provide enhanced support surface area with the intermediate support member.

It is also an object of the present invention to provide a compact three-way recliner. The three-way recliner is adapted to permit independent "reclining" movement of the seat back relative to the seat member, "tilting" movement of the chair frame relative to the base assembly, and actuation (i.e., extending and retracting) of the leg rest assembly. Tilt linkage means are provided for angularly pivoting (i.e., tilting) the entire chair frame about a horizontal axis relative to the base assembly upon actuation of the leg rest assembly for optimizing seating comfort. In addition, curved track means of the base assembly are adapted to tilt the entire chair frame upon reclining movement. As such, tilting movement due to reclining movement of the seat assembly and leg rest movement are independent of each other while being cumulative in nature.

In a preferred embodiment of the present invention, the seat assembly includes a seat back frame and a seat frame movably mounted on a chair frame and interconnected by a swing link mechanism for causing reclining movement of the seat assembly in response to pressure applied by the seat occupant. The leg rest assembly may be operated by the seat occupant rotating an actuator lever through a limited angle which, in turn, rotates a drive rod for selectively extending or retracting a pair of leg rest pantograph linkages. The pantograph linkages are uniquely suspended for synchronous actuation between the drive rod and the front support shaft and protrude through elongated apertures provided in the front cross-rail assembly. In addition, an over-centered toggle mechanism is provided to assist in extending and retracting the leg rest assembly and in retaining the leg rest assembly in its "extended" and "stowed" positions.

Furthermore, the combination reclining/rocking chair is constructed and balanced such that normal rocking movement between the chair body and the stationary base assembly is permitted without causing the seat assembly to recline, but can be quickly and easily reclined when desired. In addition, latching means are provided for permitting the seat occupant to selectively "lock" the chair body in a multitude of rearwardly "tilted" positions to arrest the rocking action upon initial extension of the leg rest assembly to its extended position. Independent of such action, slight backward pressure applied to the seat back is operable to initiate reclining movement of the seat assembly. Accordingly, an infinite number of reclined positions may be achieved upon the seat occupant shifting her body weight against the seat back.

The recliner incorporates an arm/leg rest member continuously formed between the side panel portions and leg rest member of the recliner. The arm/leg rest member is preferably in the form of a cushion extending from the front edge portion of each side panel to the outboard edge portions of the leg rest member. The arm/leg rest member includes a brace at a distal end thereof for coupling with the substructure of the leg rest member for increasing the surface area between the chair frame and the leg rest member, as well as the leg rest member itself, available for supporting the arms and legs of an occupant of the chair while enabling either arm/leg rest member (i.e., left hand and right hand) to be independently removed from the recliner for repair or replacement. The arm/leg rest members extend between the side panels and leg rest member under tension so as to provide a predictable arcuate or planar configuration for support of the seat occupant as the leg rest member is moved between its stowed and extended positions.

The recliner also incorporates an intermediate leg support member connected in between portions of the seat member and leg rest member of the recliner. The intermediate leg support member is preferably in the form of a cushion which is sewn to portions of the seat member and leg rest member. The intermediate leg support member increases its degree of convex curvature as the seat member is moved towards the leg rest member to variably support portions of the backs of the thighs and knees of the seat occupant.

Additional objects, advantages, and features of the present invention will become apparent from the following description and appended claims, taken in conjunction with the accompanying drawings.

BRIEF DESCRIPTION OF THE DRAWINGS

FIGS. 1*a*–1*d* are perspective views of an exemplary reclining chair apparatus shown in various operative positions;

DETAILED DESCRIPTION OF THE PREFERRED EMBODIMENTS

Figure 2:
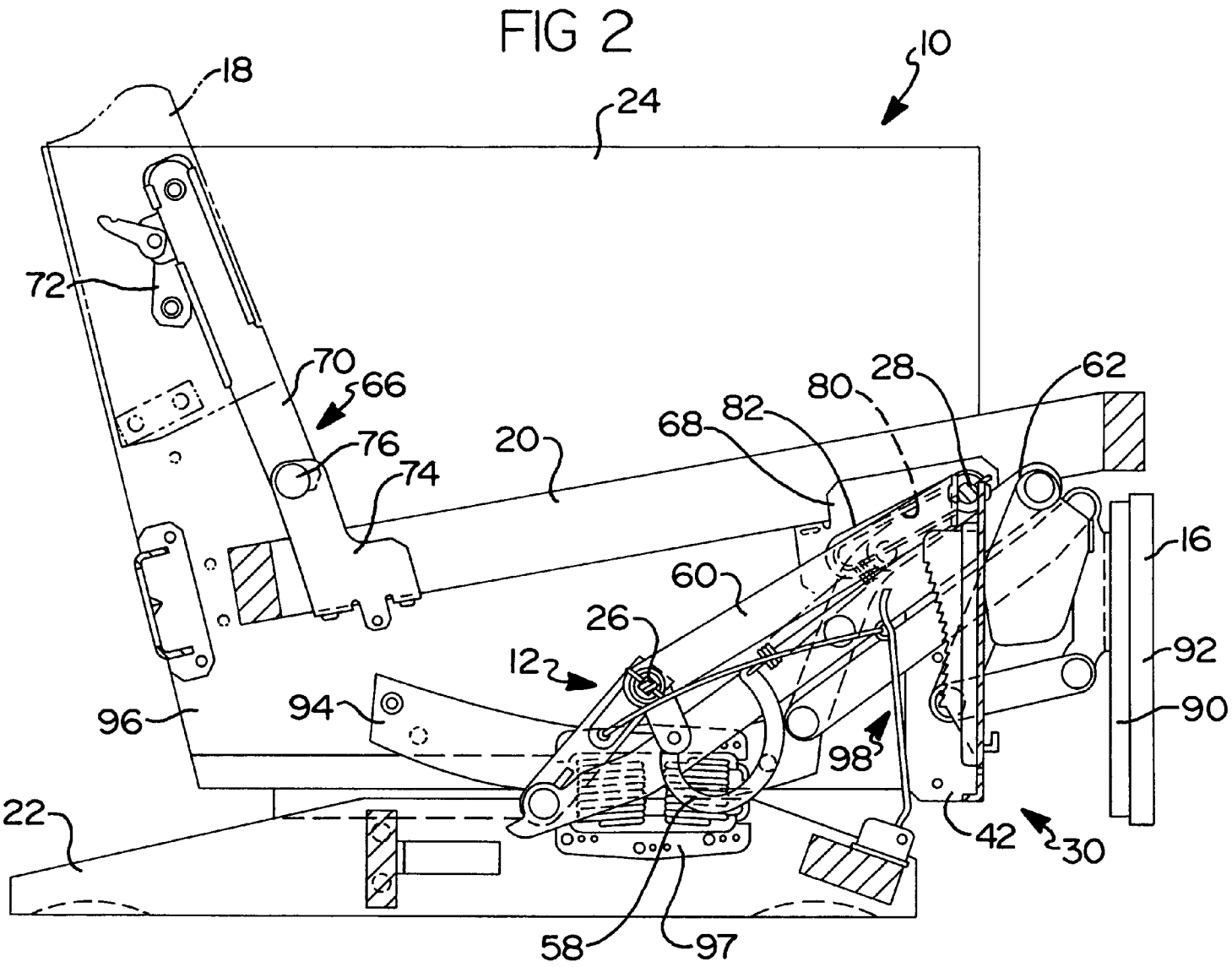
FIG. 2 is a side elevational view of the reclining chair of FIG. 1 with upholstery and other various parts removed for clarity.

In accordance with the teachings of the present invention, an improved occupant support system for use in single-person (i.e., chairs) and multi-person (i.e., sofas and loveseats) articles of furniture is disclosed. The reclining mechanism of the present invention is a "three-way" mechanism which can be actuated to independently "recline" a seat back relative to a seat member or move a leg rest assembly between retracted and extended positions. Moreover, a full range of independent "reclining" movement of the seat back relative to the seat member is possible regardless of the operative position of the leg rest assembly between its fully "retracted" and "extended" positions.

In the disclosed embodiment, the article of furniture is shown as a combination recliner and platform rocker, hereinafter referred to as "reclining/rocking chair 10". When a person sits in the reclining/rocking chair 10, the leg rest assembly is extended by selectively rotating an actuator lever. In addition, substantially concurrent "tilting" movement of the entire chair frame is provided upon such rotation of the actuator lever. The reclining movement also produces substantially concurrent "tilting" movement of the chair frame. Therefore, tilting due to reclining movement of the seat back and tilting due to movement of the leg rest assembly are automatic, independent, and cumulative in nature. The reclining mechanism of the present invention is relatively compact in size to permit use of loose upholstered cushions which is essential for marketing all styles of chair, sofa, or loveseat furniture. Finally, the reclining mechanism of the present invention provides extension of the seat member when the furniture article is in the reclined position. This forward extension, in combination with the particular type of cushion and leg rest arrangement disclosed, provides a unique arm/leg support system that will be more fully described below.

With particular reference now to the drawings, the functional and structural aspects of actuation mechanism 12, shown operably suspended from the various preupholstered box-like frame components of recliner/rocker chair 10 will now be described. More particularly, FIG. 1*a* depicts an exemplary combination reclining/rocking chair 10 having its seat assembly 14 shown in a fully "upright" position for permitting a seat occupant to enjoy conventional seating. FIG. 1*b* illustrates reclining/rocking chair 10 in the "upright" position with its associated leg rest assembly 16 shown protracted to its "extended" position. As best seen in FIG. 1*c*, seat assembly 14 includes a seat back 18 shown in a "reclined" position relative to a seat member 20 while leg rest assembly 16 is positioned in its retracted or "stowed" position. As is known, reclining movement of seat assembly 14 is accomplished by the seat occupant deliberately applying pressure to seat back 18 such that a seat swing mechanism causes seat member 20 to move forwardly and upwardly for maintaining seating comfort while the included angle increases therebetween. Chair 10 may be easily returned to its "upright" position upon deliberate application of rearward pressure to seat assembly 14 or, more simply, if the seat occupant leans forward to remove pressure from seat back 18.

Finally, FIG. 1*d* shows seat assembly 14 of chair 10 in the "reclined" position with its respective leg rest assembly 16 protracted to the "extended" position. In accordance with the embodiment shown, and as will be described from the following disclosure, the entire seat assembly 14 can be easily "rocked" with respect to stationary base assembly 22.

Figure 3:
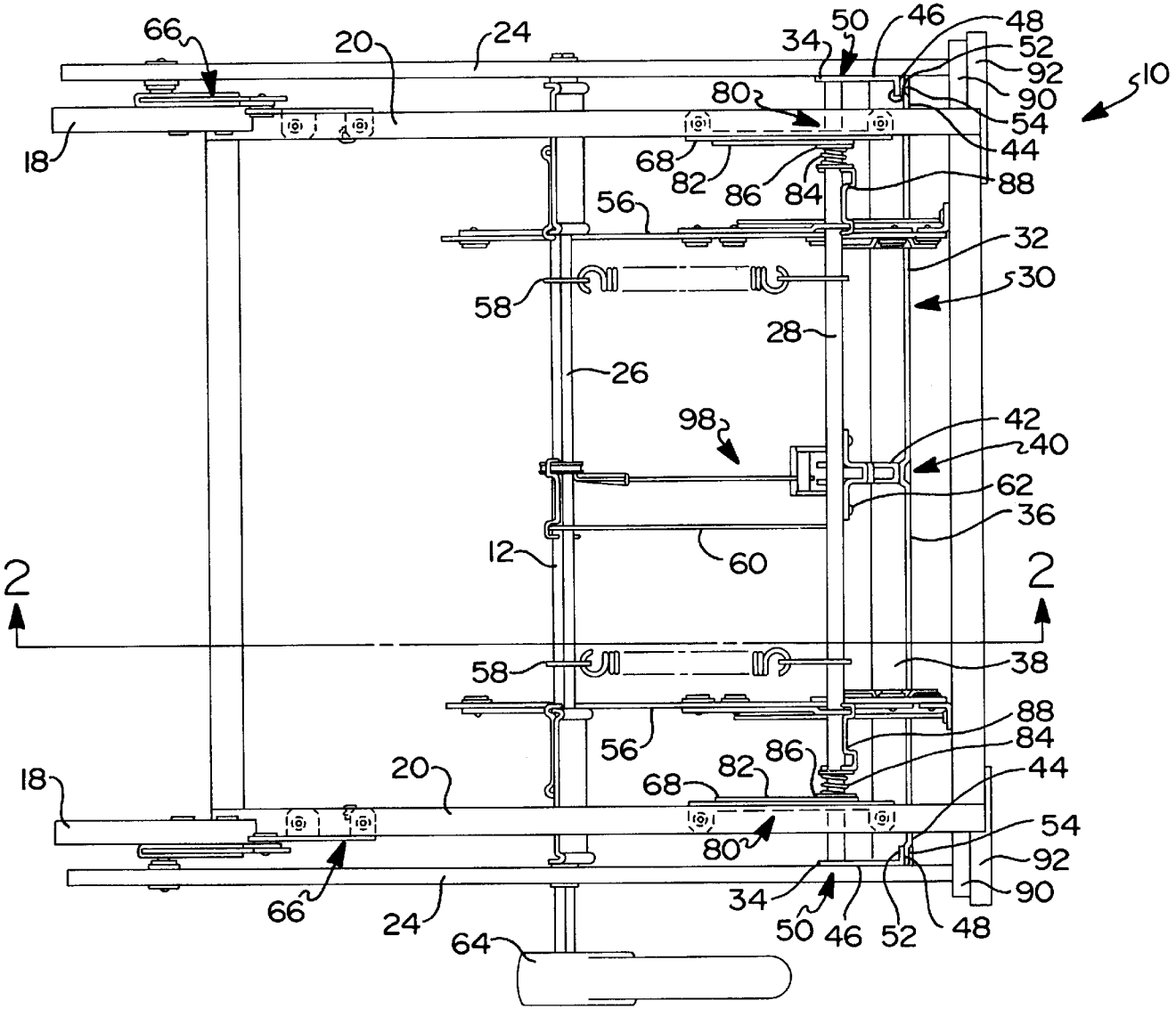
FIG. 3 is a partial plan view of the reclining chair of FIG. 2.

Turning now to FIGS. 2 and 3, reclining/rocking chair 10 is shown with its upholstery, padding, springs, etc. removed to better illustrate the interdependency of the various components and mechanical linkages. Manually operated actuation mechanism 12 of reclining/rocking chair 10 is integrated into an operably suspended from chair frame 24. Actuation mechanism 12 includes a drive rod 26 and a front support shaft 28, both of which are spatially oriented to be precisely located and "suspended" from chair frame 24. In a preferred embodiment of the present invention, a multipiece front rail assembly 30 suspends front support shaft 28 and forms rigid box-like chair frame 24. Front rail assembly 30 includes lower cross-member 32 and a pair of (i.e., left and right hand) end members 34 extending upwardly from opposite lateral ends thereof. Lower cross member 32 is generally L-shaped in cross-section having a vertical flange 36 and horizontal flange 38. Recess 40 is formed in the middle of lower cross member 32 for receiving ratchet sector 42 by locally bending vertical flange rearward and slightly off vertical. Recess 44, similar to recess 40, is formed at each end of lower cross member 32 for receiving end member 34.

End member 34 is generally L-shaped in plan view having a vertical leg 46 and a horizontal leg 48 that extends forwardly. A series of holes are formed in vertical leg 46 for securing front rail member 30 to chair frame 24. Slot 50 is also formed near the top of vertical leg 46 for receiving front support shaft 28. Transverse flange 52 extends from the front edge of vertical leg 46 towards ratchet sector 42 and is adapted to secure front support shaft 28 to end member 34. A second transverse flange 54 extends from the front edge of horizontal leg 48 towards ratchet sector 42 and is adapted to secure end member 34 to lower cross member 32. The orientation of ratchet sector 42 and recess 40, as well as transverse flange 52 and recess 44 facilitates the alignment and assembly of front rail assembly 30. A preferred method of assembling reclining/rocking chair 10 using preassembled modular frame components is thoroughly disclosed in U.S. Pat. Nos. 5,222,286, issued Jun. 29, 1993; 5,288,126, issued Feb. 22, 1994; 5,301,413, issued Apr. 12, 1994; and U.S. Pat. No. 5,435,621, issued Jul. 25, 1995 which are commonly owned by the Assignee of the present invention and the disclosures of which are expressly incorporated by reference herein.

With continued reference to FIGS. 2 and 3, actuation mechanism 12 is shown to operably support leg rest assembly 16 thereon. More specifically, leg rest assembly 16 includes left and right pantograph linkages 56 and at least one spring-assisted over-center toggle linkage 58 which are operably associated with drive rod 26 and front support shaft 28 for permitting the seat occupant to selectively actuate leg rest assembly 16. A rigid cross-brace 60 is secured between drive rod 26 and support shaft 28 for providing structural rigidity within actuation mechanism 12. Furthermore, cross-brace 60 is fixed to support shaft 28 via a threaded fastener 62 to inhibit rotation of support shaft 28 upon rotation of drive rod 26. In the preferred embodiment, drive rod 26 is an elongated square shaft having an actuation lever or handle 64 which is typically provided adjacent an upholstered exterior portion of chair frame 24 and that can be easily reached by a person seated in chair 10 for convenient actuation thereof.

As noted above, seat member 20 is supported for movement relative to chair frame 24 by seat swing linkage means for causing seat member 20 to move substantially horizontally and slightly up or down, depending on whether seat member 20 moves forwardly (i.e., during "reclining"movement) or rearwardly (i.e., on return to the "upright" position). Seat swing linkage means are shown as left and right hand rear swing linkages 66 and left and right hand front slide brackets 68. Each rear swing linkage 66 includes an elongated swing link 70, a support bracket 72 and a seat bracket 74. The lower end of each rear swing link 70 is pivoted about a pivot point 76 to an upstanding post section of seat bracket 74. Seat bracket 74 has a horizontal flange portion that is securely fixed (such as by wood screws) to an underside surface of seat member 20. As such, loading on the rear of seat member 20 passes from seat brackets 74 into rear swing links 70 as tension loading which is transferred by way of upper pivots 76 through support brackets 72 and into chair frame 24. Rear swing links 70 are elongated to provide increased leverage for balanced reclining action. Thus, the rear of seat member 20 moves much like a controlled pendulum on and below upper pivots 76. While the above description relates to a specific configuration for rear swing linkage 66, other rear swing linkage assemblies may be utilized without deviating from the scope of the present invention. For example, U.S. Pat. No. 5,184,871 entitled "Detachable Chair Back" which is commonly owned by the Assignee of the present invention and incorporated by reference herein discloses a rear swing linkage assembly which may be readily incorporated into the present invention.

Seat swing linkage means also includes a pair of (i.e., left and right) front slide brackets 68 which are operable to guide and limit fore and aft movement of seat member 20. More particularly, front support shaft 28 extends through elongated guide slots 80 formed in left and right slide brackets 68 which have horizontal flanges securely fixed (such as by wood screws) to an underside surface of the front end of seat member 20. As will be appreciated, the angularity and length of guide slots 80 defines the range of fore and aft movement of seat member 20 relative to chair frame 24 upon the seat occupant applying a force to move seat assembly 14 between the "upright" and "reclined" positions. In addition, means are also provided for generating a predetermined amount of frictional drag upon movement of seat member 20 with respect to support shaft 28. In the particular embodiment shown, a nylon insert 82 is fixedly retained within guide slots 80. In addition, compression springs 84 are provided which concentrically surround opposite ends of support shaft 28 for biasing disk-like washers 86 into frictional engagement with nylon inserts 82. Nylon inserts 82 work in conjunction with compression springs 84 for controlling the friction resistance to movement of the front end of seat assembly 14 with respect to support shaft 28 while concomitantly acting to effectively dampen noise. Left and right spacer clips 88 are provided for preloading compression springs 84 and for positively locating and retaining pantograph leg rest linkages 56 on support shaft 28.

Seat back 18 is removably mounted on an upper portion of rear swing links 66 by means of slide brackets 68 secured at suitable locations on seat back 18. In general, slide brackets 68 are channel-shaped to provide an interior track that slidably receives rear swing links 70 therein. When slide brackets 68 are mounted on rear swing links 70, seat back 18 is, in effect, an extension of rear swing links 70 above pivot points 76. As such, seat back 18 can be pivoted about pivots 76 for acting as a lever arm for causing relatively easy angular movement of rear swing links 70 and fore and aft movement of seat member 20.

Leg rest assembly 16 is shown to include a frame board 90 having winglets 92 fixed (such as by wood screws) thereto which are supported and moved by identical left and right hand pantograph linkages 56. Pantograph linkages 56 may be similar in function and structure to that shown in FIG. 3 of U.S. Pat. No. 3,096,121, assigned to the common assignee of the present invention, with the exception that pantograph linkages 56 are operably suspended from support shaft 28. Alternatively, pantograph linkages 56 may be similar in function and structure to that described in U.S. Pat. No. 5,582,457, entitled "Dual Leg Rest Assembly", issued on Dec. 10, 1996, which is commonly owned by the Assignee of the present invention and incorporated by reference herein. The "extensible" action takes place simultaneously with both the left hand and right hand pantograph linkages 56 when there is sufficient angular rotation of drive rod 26 via rotation of actuation handle 64. In this manner, frame board 90 is movable between a normally "stowed" position when pantograph linkages 56 are retracted and an "extended" position when pantograph linkages 56 are protracted. As is known, leg rest assembly 16 may be returned to its "stowed" position upon the seat occupant applying a rearwardly directed force on frame board 90 or upon rotation of actuation handle 64 in the opposite direction.

To provide means for permitting chair frame 24 to rock relative to stationary base assembly 22, contoured rocker blocks 94 are secured to inner surfaces of chair frame side panels 96. Rocker blocks 94 are positioned to engage an upper surface of base assembly 22 in a "rockable" relation therewith. Preferably, rocker blocks 94 are interconnected to base assembly 22 by a double coil spring "rocker" device 97 similar to that disclosed in U.S. Pat. No. 5,171,000 issued on Dec. 15, 1992, commonly owned by the assignee of the present invention, the disclosure of which is expressly incorporated by reference herein. As will be appreciated, the rocker spring device is operable to permit balanced rocking movement of chair frame 24 with respect to fixed base assembly 22 without causing seat assembly 14 to recline inadvertently.

As an additional comfort feature, latching means 98 are provided for releasably retaining chair frame 24 in any one of a plurality of rearwardly "tilted" sequential positions upon angular rotation of drive rod 26 via rotation of actuation handle 64. As such, latching means 98 is operable to inhibit forward rocking movement of chair frame 24 following initial rearward movement of chair frame 24 to a desired "tilted" position. Preferably, latching means 98 is similar to the pawl and ratchet latching mechanism disclosed in U.S. Pat. No. 5,527,095 issued on Jun. 18, 1996, which is commonly owned by the Assignee of the present invention and the disclosure of which is expressly incorporated by reference herein.

Figure 4:
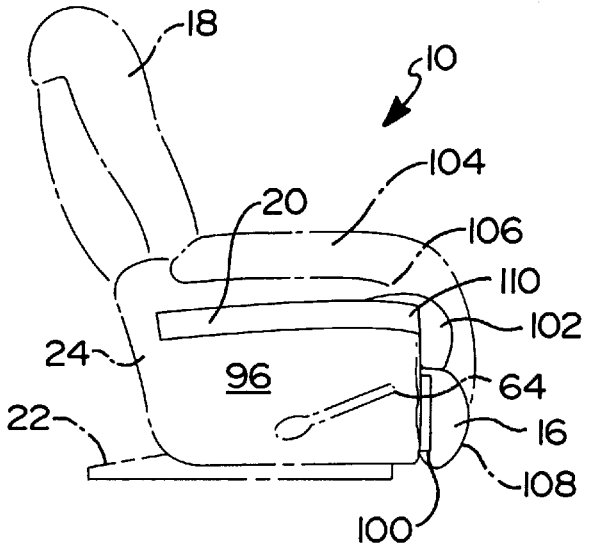
FIG. 4 is a side view of the reclining chair illustrating the highly arcuate shape of the arm/leg rest member when the leg rest member and seat member are in their retracted positions.
Figure 5:
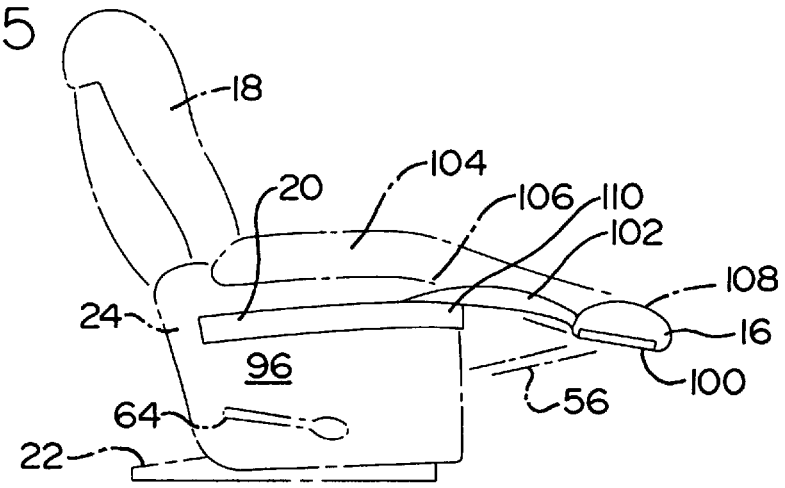
FIG. 5 is a side view of the reclining chair illustrating the essentially planar shape of the arm/leg rest member between the side panel and the leg rest as well as the normal convex shape of the intermediate leg support member which are assumed when the seat member of the recliner is in its retracted position and the leg rest member is in its extended position.
Figure 6:
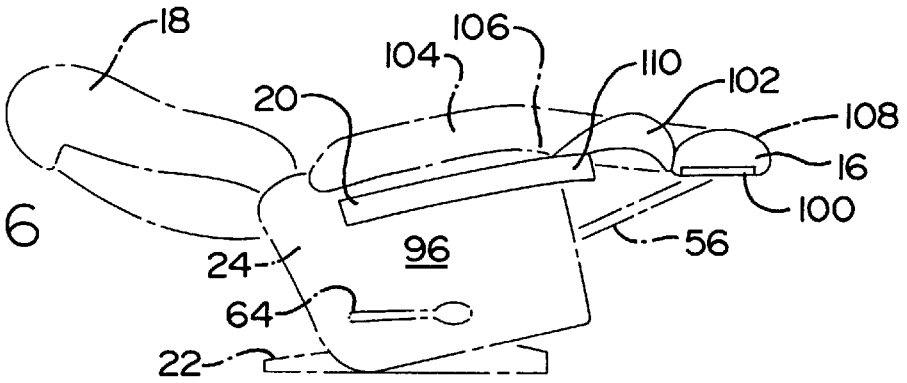
FIG. 6 is a side view of the reclining chair illustrating the pronounced convex shape of the intermediate leg support member and the essentially horizontal yet still planar configuration of the arm/leg rest member which are assumed when the seat member and leg rest member of the recliner are in their extended positions.

Referring now to FIGS. 4–6, the reclining/rocking chair 10 is illustrated in several side views. As hereinbefore described, the reclining/rocking chair 10 generally includes a reclinable seat back member 18 which is operationally coupled to chair frame 24, a slidably extendible and retractable seat member 20 and an extendible and retractable leg rest assembly 16 having leg rest member 100 and pantograph leg rest linkages 56 for retractably extending leg rest member 100. Coupled in between a portion of the seat member 20 and the leg rest member 100 is an intermediate leg support member 102. Further, a pair of (i.e., left hand and right hand) arm/leg rest members 104 are coupled between side panels 96 of the chair frame 24 and leg rest member 100. The intermediate leg support member 102 preferably comprises a flexible, independent leg support cushion which is operable to assume a pronounced, convex shape when the seat member 20 is in the extended position. The arm/leg rest member 104 preferably comprises an elongated support cushion which is operable to move between a retracted position adjacent chair frame 24 and an extended position spaced apart from chair frame 24 and assume variable preselected, arcuate and planar shapes as the leg rest member 100 moves between its stowed and extended positions.

In FIG. 4, the chair 10 is illustrated in its upright position with the leg rest member 100 fully retracted. In this position the arm/leg rest member 102 is highly arcuately shaped and curves over an end portion 106 of side panels 96 and terminates at a distal end 108 at the leg rest member 100. As such, arm/leg rest member 104 is in its retracted position adjacent the chair frame 24 and does not hamper the use of chair 10 as an upright chair. Similarly, in this position, the intermediate leg support member 102 folds over an end portion 110 of seat member 20. Accordingly, intermediate leg support member 102 does not hamper the use of chair 10 as an upright chair and an occupant may sit comfortably in the chair 10 in an upright position without undue interference from support member 102 or arm/leg rest member 104.

In FIG. 5, it will be noted that the distance between leg rest member 100 and chair frame 24 is substantially the same regardless of whether seat member 20 is in its extended or retracted position and regardless of whether the seat back 18 is in its upright or reclined positions. However, the distance between the seat member 20 and the leg rest member 100 decreases when the seat member 20 is in its extended position. The decrease in this distance can further be understood from FIG. 6 wherein the chair 10 is shown with the seat back member 18 in its reclined position, the seat member 20 in its extended position, and the leg rest member 100 in its extended or protracted position. Since the leg rest member 100, when in its extended position, is held at a fixed distance relative to chair frame 24, the outward extension of seat member 20 operates to shorten the distance between the points at which intermediate leg support member 102 is attached to the leg rest member 100 and to seat member 20. The extension of seat member 20 causes the portion of the intermediate leg support member 102 that is attached to seat member 20 to move toward leg rest member 100 and results in intermediate support member 102 assuming the pronounced convex shape illustrated in FIG. 6.

When the seat back 18 is in its upright position and seat member 20 is in its retracted position with leg rest member 100 extended as shown in FIG. 5, the distance between the leg rest member 100 and seat member 20 is such that the intermediate support member 102 is stretched out and assumes its normal, slightly convex shape, as illustrated. The adaptability of the intermediate leg support member 102 to assume both pronounced and slightly convex shapes provides varying degrees of support to the legs of an occupant of the recliner/rocker chair 10 as the seat back member 18 is reclined. Thus, the chair 10 serves to provide continuous support from the upper back of the occupant to the feet in a manner similar to that of a chaise lounge, but with significant added control and adjustability not otherwise normally found with chaise lounge chairs.

It will also be noted that the intermediate leg support member 102 is discretely formed (i.e., not secured to) arm/leg rest member 104 so that it is free to move relative thereto to assume pronounced and slightly convex shapes. As such, the change in distance between leg rest member 100 and seat member 20 occurs independently of arm/leg rest member 104. However, as the leg rest member 100 is moved between its retracted and extended positions, the arm/leg rest member 104 moves between its retracted and extended positions and assumes different degrees of arcuate curvature and finally a planar configuration relative to the chair frame 24.

Preferably, the leg rest member 100 is of the type positionable in at least four positions relative to chair frame 24. That is, the leg rest member 100 is positionable to a fully retracted position, a one-third extended position, a two-thirds extended position, and a fully extended position. The arm/leg rest member 104 moves in concert with the leg rest member 100 from a highly arcuate shape adjacent the chair frame 24 when the leg rest member 100 is fully retracted to an essentially planar configuration between the side panels 96 and the leg rest member 100 when the leg rest member 100 is fully extended. The arm/leg rest member 104 assumes slightly less arcuate shapes in each of the one-third and two-thirds extended positions of the leg rest member 100. As such, the arm/leg rest member 104 provides enhanced support surface area for the arms and legs of the seat occupant as well as increased containment of the seat occupant by providing a border outboard of the intermediate leg support member 102. Thus, the seat occupant has a greater range of mobility (i.e., places to rest her arms and legs) in each of the extended positions of the leg support member 100.

Figure 7:
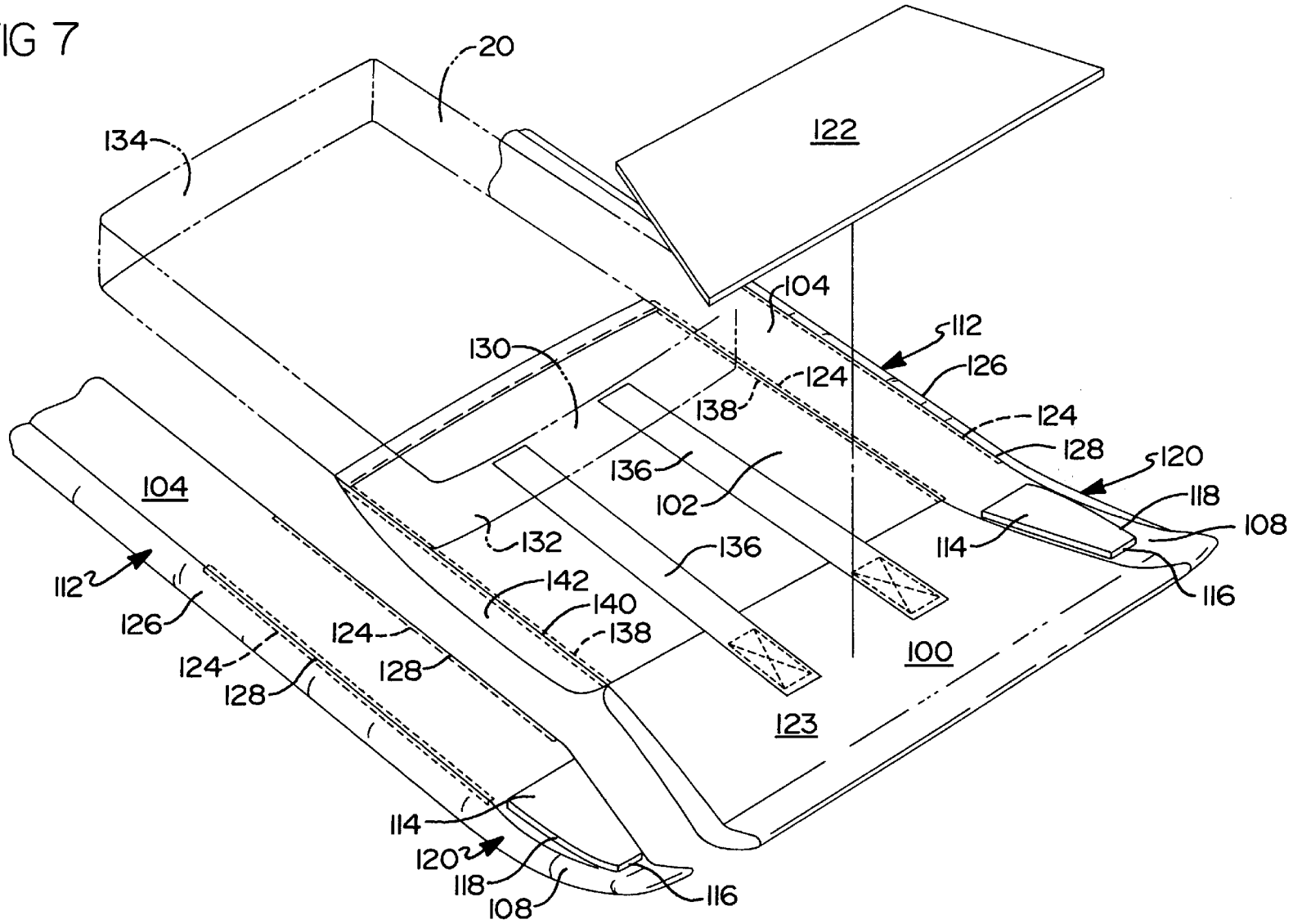
FIG. 7 is a perspective view of an under surface of the intermediate support member, arm/leg rest member, and leg rest member illustrating the plurality of independent elastic straps coupled between interior portions of the arm/leg rest members, interior portion of the intermediate leg support member, and between the seat member of the recliner and the leg rest member and the discrete winglets disposed at the distal end of each arm/leg rest member for coupling with the substructure of the leg rest member.

Referring to FIG. 7, the arm/leg rest member 104 extends between the side panels 96 (see FIGS. 4–6) and leg rest member 100 to form a portion of the arm rests 112 and the leg rest member 100. A generally triangularly shaped winglet 114 having a truncated vertex 116 and a curved edge 118 is secured by staples or the like to the under surface of the distal end 108 of each arm/leg rest member 104. The curved edge 118 yields a rounded configuration to the outboard side edges 120 of the arm/leg rest member 104 when the winglets 114 are secured to the trapezoidal shaped substrate 122 of the leg rest member 100 which slightly overhangs the leg rest cushion 123 to provide an attachment area for winglets 114. The winglets 114 also enable the left hand and right hand arm/leg rest members 104 to be removed from the side panels 96 and leg rest member 100 independently in the event that repair or replacement becomes necessary.

One end of a plurality of independent elastic straps 124 are fixedly secured interior of the fabric enclosure 126 of the arm/leg rest member 104 such as by sewing, stitching, or any other like method of attachment suitable to produce a secure attachment of the straps to a fabric seam 128 along the outboard and inboard edges of the arm/leg rest member 104 between the front edge portion of front end portion of the side panel members 96 and the outboard edges of the leg rest member 100. A predetermined amount of stretching or tension is imparted to the elastic straps 124 and, while in such tensioned state, the straps 124 are attached to arm/leg rest member 104. The amount of tensioning that is imparted to the straps is such that when the leg rest member 100 is retracted, there is sufficient tension in straps 124 to prevent arm/leg rest member 104 from bunching or gapping outwardly from the chair frame 24. Further, the amount of tensioning imparted to the straps 124 is such that when the leg rest member 100 is extended to either of its three positions (i.e., ⅓, ⅔ or fully extended), there is sufficient tension in the straps 124 to maintain a progressively less arcuately and finally planar shaped, yet always non-bunched, configuration. In a preferred embodiment, two laterally spaced elastic straps 124 are sewn into the fabric seams 128 of each (i.e., left hand and right hand) arm/leg rest member 104, each strap being approximately one inch wide. Sewing the straps 124 into the seams 128 has the added benefit of relieving stress on the seams 128 when the leg rest member 100 is extended and a load is applied.

Still referring to FIG. 7, the intermediate leg support member 102 is coupled to an attachment area 130 of seat member 20 which is intermediate a front end portion 132 and a rear end portion 134 of the seat member 20. One end of a plurality of independent elastic straps 136 are fixedly secured such as by sewing to a front edge portion of front end portion 132 of the seat member 20. A predetermined amount of stretching or tension is imparted to the free ends of the elastic straps 136 and, while in such tensioned state, the straps 136 are attached to leg rest member 100. The amount of tension that is imparted to the straps 136 is such that when the leg rest member 100 is extended and the recliner/rocker chair 10 is in its upright position, there is sufficient tension in straps 136 to prevent intermediate support member 102 from crowning downwardly in a concave configuration when the seat member 20 extends forwardly as the seat back 18 moves between its upright and reclined positions. Even when recliner/rocker chair 10 is in its fully reclined position, a small amount of tension still is imparted to the elastic straps 136. In a preferred embodiment, two laterally spaced elastic straps 136 are provided, each strap being approximately three inches wide. The elastic straps 136 are secured to the leg rest member 100 by sewing, stitching or any other like method of attachment suitable to produce a secure attachment of the straps 136.

Further, one end of a plurality of independent elastic straps 138 are secured such as by sewing along fabric seams 140 interior of fabric enclosure 142 between front end portion 132 of seat member 20 and foot rest member 100. A predetermined amount of stretching or tension is imparted to the elastic straps 138 such that when the leg rest member 100 is extended and the seat member 20 is slid forward, a controlled convex shape is imparted to the intermediate leg rest member 102. Further, upon returning the seat member 20 to the retracted position, the elastic straps 138 ensure a return of the intermediate leg rest member 102 to a predictable configuration relative to the seat member 20 such that the slightly convex shape is realized. Thus, even when seat member 20 is in its fully retracted position, a small amount of tension still is imparted to the elastic straps 138. In a preferred embodiment, two laterally spaced elastic straps are sewn into the fabric seams 140 along the outboard edges of the intermediate seat member 102, interior of the fabric enclosure 142, each strap being approximately one inch wide.

Figure 8:
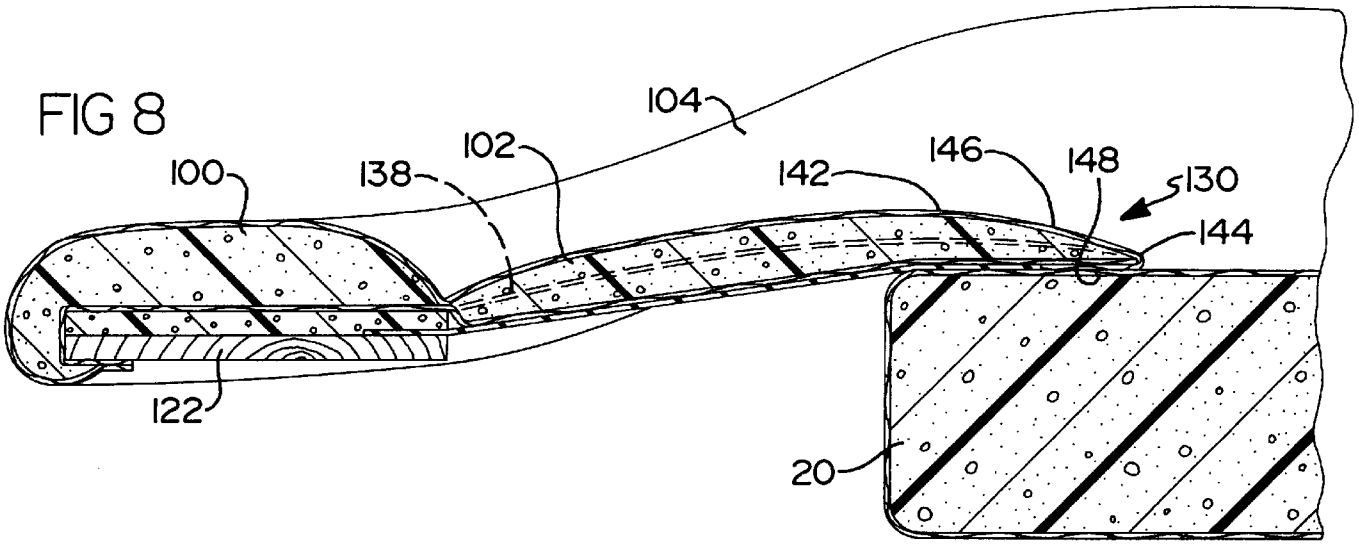
FIG. 8 is a cross-sectional side view showing more clearly the construction and interconnection of the intermediate leg support member as it is coupled between the seat member and the leg rest member.

With reference to FIG. 8, the seat member 20 is shown in the extended position. The intermediate leg support member 102 is coupled at connection area 130 with seat member 20 via an edge portion 144 of intermediate leg support member 102. Edge portion 144 comprises outer portion 146 and inner portion 148 of outer fabric material 142 of the intermediate leg support member 102 which is coupled preferably by sewing, stitching, or in a similar manner to seat member 20. This provides a particularly good attachment of the intermediate leg support member 102 to the seat member 20 to resist pulling and tugging as an occupant of the chair 10 moves about in the chair, and also when leg rest member 100 is urged into its fully retracted state.

Figure 9:
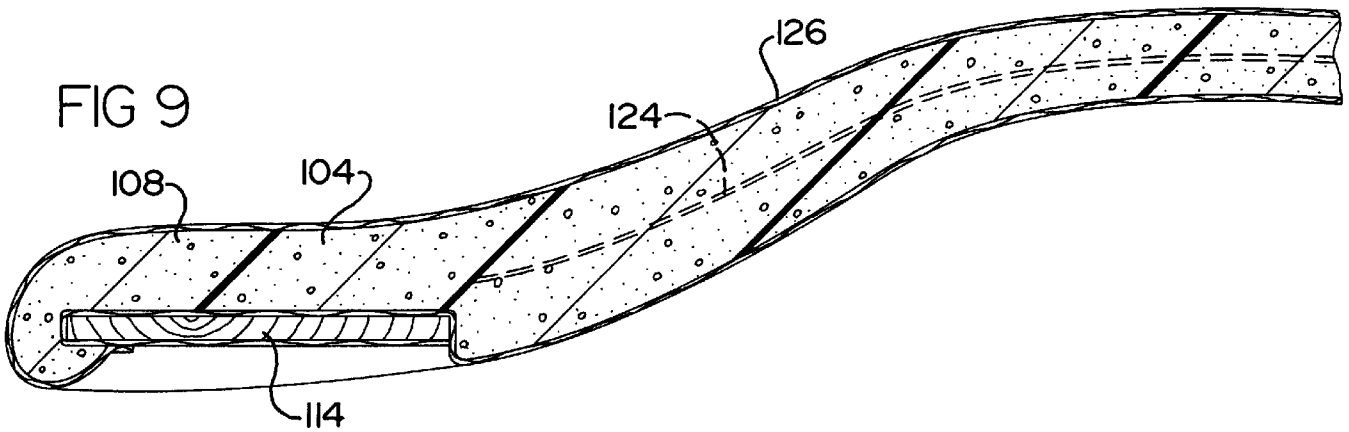
FIG. 9 is a cross-sectional side view showing more clearly the construction and interconnection of the ar/leg rest member as it extends between the side panel portion and the leg rest member.

With reference to FIG. 9, the arm/leg rest member is shown in the extended position. Straps 124 are embedded within the of outer fabric material 126 and are coupled thereto preferably by sewing, stitching, or in a similar manner. The fabric material 126 is coupled to winglet 114 which is adapted to be fixed (such as by wood screws) to leg rest member 100 and is secured to side panel members 96 (FIGS. 4–6) by staples, stitching, or in a similar manner. This provides a particularly good attachment of the arm/leg rest member 104 to side panels 96 and leg rest member 100 to resist pulling and tugging as an occupant of the recliner/rocker chair 10 moves about, and also when leg rest member 100 is urged between its fully retracted and extended states. Further, each arm/leg rest member 104 can be independently removed from the leg rest member 100 for repair or replacement.

Although the chair 10 will in most instances operate without any modifications to the reclining mechanism discussed hereinbefore, in some instances, depending upon the tension force which is created by the elastic straps 124, 136 and 138 which are secured to the leg rest member 100 and seat member 20 or side panels 96, it may be necessary to include additional counter-balancing force means in the form of springs or other like biasing means to help maintain the leg rest member 100 in its extended position. If such is found to be the case, an additional spring, as well as an additional spring bracket and C-shaped toggle lever may be included to provide additional biasing force to help hold the leg rest member 100 in its extended position.

While the intermediate leg support member 102 and arm/leg rest member 104 of the present invention are shown and described as part of the reclining/rocking chair 10, it should be appreciated that the chair 10 could be adapted to incorporate a wall proximity recliner mechanism as described in previously referenced U.S. Pat. No. 5,156,441.

Thus, the reclining/rocking chair 10 of the present invention serves to provide an integral arm/leg rest member 104 which contains and provides increased surface area for additionally supporting the arms and legs of an occupant of the chair 10 when the leg rest 100 is extended. The chair 10 of the present invention also serves to provide an intermediate leg support member 102 which crowns upwardly to provide additional support to the thighs and behind the knee areas of an occupant of the chair 10 when the leg rest member 100 and seat member 20 are extended. The chair 10 of the present invention thus provides increased comfort to an occupant without utilizing additional, loose pillows or the like.

The foregoing discussion discloses and describes an exemplary embodiment of the present invention. One skilled in the art will readily recognize from such discussion, and from the accompanying drawings and claims, that various changes, modifications and variations can be made therein without departing from the spirit and scope of the invention as defined in the following claims.

What is claimed is:

1. A chair comprising:

a seat section having a pair of vertically disposed side panels and a leg rest member movable between a retracted and extended position;

an arm/leg rest member coupled between and to said side panels and said leg rest member, said arm/leg rest member movable between a retracted and extended position and being operable to form a support surface having a variable degree of curvature;

an actuation means for moving said leg rest member between said retracted and extended positions, wherein movement of said leg rest member toward said extended position causes said arm/leg rest member to be urged from said retracted position and an arcuately shaped support configuration to said extended position and an essentially planar shaped support configuration; and at least one elastic strap secured under tension intermediate an edge portion of each of said side panels and said leg rest member, said elastic strap extending generally longitudinally of said arm/leg rest member and being operable to provide support to said arm/leg rest member and control said variable degree of curvature when said leg rest is moved relative to said side panels.

2. The chair of claim 1 wherein said elastic strap extends within a fabric enclosure of said arm/leg rest member.

3. The chair of claim 1 further comprising:

a generally linearly movable seat member disposed between said side panels; and an intermediate leg support member coupled between and to said leg rest member and said seat member, said intermediate leg support member being operative to form a convex support surface having a variable degree of curvature.

4. The chair of claim 3 further comprising:

means for enabling said seat member to be urged generally linearly toward said leg rest member, wherein movement of said seat member toward said leg rest member causes said intermediate leg support member to be urged from a first, convexly shaped support configuration into a second, convexly shaped support configuration, wherein said second convexly shaped support configuration has a greater degree of convex curvature than said first convexly shaped support configuration.

5. The chair of claim 3 further comprising:

at least one elastic strap secured under tension intermediate an edge portion of said seat member and said leg rest member, said elastic strap extending generally longitudinally along an under surface of said intermediate leg support member and being operable to provide support to said intermediate leg support member and control said variable convex shape when said seat member is moved relative said leg rest member.

6. The chair of claim 3 further comprising:

at least one elastic strap secured under tension intermediate a portion of said seat member and said leg rest member, said elastic strap extending generally longitudinally within a fabric enclosure of said intermediate leg support member and being operable to provide support to said intermediate leg support member and control said variable convex shape when said seat member is moved relative said leg rest member.

7. A recliner chair comprising:

a chair frame having a reclinable seat back member, a seat member operationally coupled to said reclinable seat back member such that reclining of said seat back member causes said seat member to be urged slidably outwardly in a generally linear movement relative to said chair frame, and a leg rest member movable between a retracted position and an extended position, said seat member being slidably movable toward said leg rest member;

an arm/leg rest member coupled between said chair frame and said leg rest member;

an intermediate leg rest support member coupled intermediate a portion of said seat member and said leg rest member;

an actuation means for moving said leg rest member between said retracted and extended positions, wherein movement of said leg rest member toward said extended position causes said arm/leg rest member to be urged from a retracted, arcuately shaped support configuration through a range of partially extended, less arcuately shaped support configurations to a fully extended, essentially planar shaped support configuration; and a plurality of elastic straps secured under tension intermediate an edge portion of said chair frame and said leg rest member, said elastic straps extending generally longitudinally of said arm/leg rest member and being operable to provide support to said arm/leg rest member and control said shaped support configurations when said leg rest member is moved relative to said chair frame.

8. The recliner chair of claim 7 wherein the arm/leg rest member is operable to fold over a front end portion of said chair frame when said leg rest member is in said retracted position.

9. The recliner chair of claim 7 wherein the arm/leg rest member is operable to extend essentially horizontally across an expanse between the chair frame and the leg rest member when said leg rest member is in said extended position.

10. The recliner chair of claim 7 further comprising:

means for causing said intermediate leg support member to assume a first convex shape relative to said seat member and provide support to the legs of an occupant of said chair when said leg rest member is in an extended position and said seat back member is in an upright position, said means also causing said intermediate leg support member to assume a second convex shape relative to said seat member independent of said arm/leg rest member when said leg rest member is in said extended position and said seat back member is urged into a reclined position, said second convex shape being operable to provide an increased degree of support to the legs of said occupant.

11. The recliner chair of claim 10 further comprising:

a plurality of elastic straps secured under tension to, and extending generally longitudinally intermediate of, an edge portion of said seat member and a portion of said leg rest member, said elastic straps being operable to help maintain said intermediate leg support member in said first and second convex shapes when said leg rest member is in said extended position and said seat member is slidably urged toward said leg rest member.

12. The recliner chair of claim 7 wherein said armbeg rest member further comprises a flexible, integral arm/leg rest cushion.

13. The recliner chair of claim 12 wherein said arm/leg rest cushion is secured by fasteners to an upper surface of a side panel of said chair frame.

14. The recliner chair of claim 12 wherein said arm/leg rest cushion further comprises a brace structure secured to a distal end thereof for coupling with a substrat e of said leg rest member.

15. The recliner chair of claim 14 wherein said substrate of said leg rest member further comprises a trapezoid shaped member.

16. The recliner chair of claim 14 wherein said brace structure further comprises a generally triangularly shaped member having a curved edge, said curved edge yielding a rounded external side shape to said distal end of said arm/leg rest cushion.

17. A recliner chair having enhanced surface area for resting an occupant's arms and legs comprising:

a chair frame;

a reclinable seat back member operationally coupled to said chair frame, said seat back member being operable to assume at least one upright position and a reclined position;

a seat member operationally coupled to said chair frame and said seat back member, said seat member being operable to assume a retracted position when said seat back member is in said upright position and to be urged slidably outwardly of said chair frame into an extended position in response to reclining of said seat back member into said reclined position;

an extendable leg rest assembly including a leg rest member operationally coupled to said chair frame and operable to be urged outwardly of said chair into an extended position and retracted into a retracted position;

an intermediate leg support member coupled to a portion of said seat member and a portion of said leg rest member, said intermediate leg support member having an upper surface operable to assume a slightly convex shape relative to said seat member when said seat member is in said retracted position and said leg rest member is in said extended position, said intermediate leg support member further being operable to assume a pronounced convex shape relative to said seat member when said seat member and said leg rest assembly are in their respective extended positions;

an arm/leg rest member coupled to a portion of said chair frame and a portion of said leg rest member, said arm/leg rest member having an upper surface operable to assume a highly arcuate shape relative to said chair frame when said leg rest member is in said retracted position, said arm/leg rest member further being operable to assume a planar shape relative to said chair frame when said leg rest member is in said extended position; and a plurality of independent elastic straps secured intermediate an edge portion of said chair frame and an edge portion of said leg rest member, said elastic straps being secured under tension adjacent said arm/leg rest member and thereby maintaining said arm/leg rest member in said highly arcuate and planar shapes respectively when said leg rest member is in said retracted and extended positions.

18. The recliner chair of claim 17 further comprising:

a pair of rocker blocks fixedly secured to said chair frame;

a base assembly; and a pair of spring assemblies adapted to be secured to said rocker blocks and said base assembly so as to secure said rocker blocks to said base assembly to thereby enable said chair frame to rock on said base assembly.

19. The recliner chair of claim 17, wherein said elastic straps are secured under tension within an interior of a fabric enclosure of said arm/leg rest member.

20. A chair comprising:

a seat section having a pair of vertically disposed side panels and a leg rest member movable between a retracted and extended position, said seat section including a generally linearly movable seat member disposed between said side panels;

an arm/leg rest member coupled between and to said side panels and said leg rest member, said arm/leg rest member movable between a retracted and extended position and being operable to form a support surface having a variable degree of curvature;

an intermediate leg support member coupled between and to said leg rest member and said seat member, said intermediate leg support member being operative to form a convex support surface having a variable degree of curvature;

an actuation means for moving said leg rest member between said retracted and extended positions, wherein movement of said leg rest member toward said extended position causes said arm/leg rest member to be urged from said retracted position and an arcuately shaped support configuration to said extended position and an essentially planar shaped support configuration; and at least one elastic strap secured under tension intermediate a portion of said seat member and said leg rest member, said elastic strap extending generally longitudinally of said intermediate leg support member and being operable to provide support to said intermediate leg support member and control said variable convex shape when said seat member is moved relative said leg rest member.

21. The chair of claim 20 wherein said elastic strap extends within a fabric enclosure of said intermediate leg support member.

22. The chair of claim 20 further comprising:

at least one other elastic strap secured under tension intermediate an edge portion of each of said side panels and said leg rest member, said at least one other elastic strap extending generally longitudinally of said arm/leg rest member and being operable to provide support to said arm/leg rest member and control said variable degree of curvature when said leg rest member is moved relative to said side panels.

23. The chair of claim 22 wherein said at least one other elastic strap extends within a fabric enclosure of said arm/leg rest member.

24. A recliner chair comprising:

a chair frame having a reclinable seat back member, a seat member operationally coupled to said reclinable seat back member such that reclining of said seat back member causes said seat member to be urged slidably outwardly in a generally linear movement relative to said chair frame, and a leg rest member movable between a retracted position and an extended position, said seat member being slidably movable toward said leg rest member;

an arm/leg rest member coupled between said chair frame and said leg rest member, said arm/leg rest member including a flexible, integral arm/leg rest cushion and a brace structure secured to a distal end thereof for coupling with a substrate of said leg rest member, said brace structure including a generally triangularly shaped member having a curved edge, said curved edge yielding a rounded external side shape to said distal end of said arm/leg rest cushion;

an intermediate leg rest support member coupled intermediate a portion of said seat member and said leg rest member; and an actuation means for moving said leg rest member between said retracted and extended positions, wherein movement of said leg rest member toward said extended position causes said arm/leg rest member to be urged from a retracted, arcuately shaped support configuration through a range of partially extended, less arcuately shaped support configurations to a fully extended, essentially planar shaped support configuration.

25. The recliner chair of claim 24 further comprising:

at least one elastic strap secured under tension intermediate an edge portion of said chair frame and said leg rest member, said elastic strap extending generally longitudinally of said arm/leg rest member and being operable to provide support to said arm/leg rest member and control said shaped support configurations when said leg rest member is moved relative to said chair frame.

26. The recliner chair of claim 24 further comprising:

means for causing said intermediate leg support member to assume a first convex shape relative to said seat member and provide support to the legs of an occupant of said chair when said leg rest member is in an extended position and said seat back member is in an upright position, said means also causing said intermediate leg support member to assume a second convex shape relative to said seat member independent of said arm/leg rest member when said leg rest member is in said extended position and said seat back member is urged into a reclined position, said second convex shape being operable to provide an increased degree of support to the legs of said occupant.

27. The recliner chair of claim 26 further comprising:

at least one elastic strap secured under tension to, and extending generally longitudinally intermediate of, an edge portion of said seat member and a portion of said leg rest member, said elastic strap being operable to help maintain said intermediate leg support member in said first and second convex shapes when said leg rest member is in said extended position and said seat member is slidably urged toward said leg rest member.

28. A recliner chair comprising:

a chair frame having a reclinable seat back member, a seat member operationally coupled to said reclinable seat back member such that reclining of said seat back member causes said seat member to be urged slidably outwardly in a generally linear movement relative to said chair frame, and a leg rest member movable between a retracted position and an extended position, said seat member being slidably movable toward said leg rest member;

an arm/leg rest member coupled between said chair frame and said leg rest member, said arm/leg rest member including a flexible, integral arm/leg rest cushion and a brace structure secured to a distal end thereof for coupling with a substrate of said leg rest member, said substrate of said leg rest member having a trapezoid shaped member;

an intermediate leg rest support member coupled intermediate a portion of said seat member and said leg rest member; and an actuation means for moving said leg rest member between said retracted and extended positions, wherein movement of said leg rest member toward said extended position causes said arm/leg rest member to be urged from a retracted, arcuately shaped support configuration through a range of partially extended, less arcuately shaped support configurations to a fully extended, essentially planar shaped support configuration.

29. The recliner chair of claim 28 further comprising:

at least one elastic strap secured under tension intermediate an edge portion of said chair frame and said leg rest member, said elastic strap extending generally longitudinally of said arm/leg rest member and being operable to provide support to said arm/leg rest member and control said shaped support configurations when said leg rest member is moved relative to said chair frame.

30. The recliner chair of claim 28 further comprising:

means for causing said intermediate leg support member to assume a first convex shape relative to said seat member and provide support to the legs of an occupant of said chair when said leg rest member is in an extended position and said seat back member is in an upright position, said means also causing said intermediate leg support member to assume a second convex shape relative to said seat member independent of said arm/leg rest member when said leg rest member is in said extended position and said seat back member is urged into a reclined position, said second convex shape being operable to provide an increased degree of support to the legs of said occupant.

31. The recliner chair of claim 30 further comprising:

at least one elastic strap secured under tension to, and extending generally longitudinally intermediate of, an edge portion of said seat member and a portion of said leg rest member, said elastic strap being operable to help maintain said intermediate leg support member in said first and second convex shapes when said leg rest member is in said extended position and said seat member is slidably urged toward said leg rest member.

* * * * *